US009166274B2

(12) United States Patent
Bennett

(10) Patent No.: US 9,166,274 B2
(45) Date of Patent: Oct. 20, 2015

(54) STANDARDISED MONOPOLE STRENGTHENING

(75) Inventor: Alan Samuel Bennett, Chatswood (AU)

(73) Assignee: Crown Castle Australia Pty Ltd, Chatswood, New South Wales (AU)

( * ) Notice: Subject to any disclaimer, the term of this patent is extended or adjusted under 35 U.S.C. 154(b) by 488 days.

(21) Appl. No.: 13/435,690

(22) Filed: Mar. 30, 2012

(65) Prior Publication Data

US 2012/0248281 A1 Oct. 4, 2012

(30) Foreign Application Priority Data

Apr. 1, 2011 (AU) ..... 2011901408

(51) Int. Cl.
*E04C 3/00* (2006.01)
*H01Q 1/12* (2006.01)
*E04H 12/08* (2006.01)

(52) U.S. Cl.
CPC ..... *H01Q 1/1242* (2013.01); *E04H 12/085* (2013.01)

(58) Field of Classification Search
USPC ..... 52/40, 223.4, 223.5, 223.7, 296, 297, 52/651.01, 651.02, 745.04, 745.17, 834, 52/835, 848, 849; 174/45 R; 416/DIG. 6; 343/874, 875
See application file for complete search history.

(56) References Cited

U.S. PATENT DOCUMENTS

| | | | | |
|---|---|---|---|---|
| 6,453,636 | B1 | 9/2002 | Ritz | |
| 6,665,990 | B1 * | 12/2003 | Cody et al. | 52/295 |
| 6,742,314 | B2 * | 6/2004 | Young | 52/835 |
| 7,591,119 | B2 * | 9/2009 | Ritz | 52/835 |
| 2002/0170261 | A1 | 11/2002 | Brunozzi et al. | |
| 2004/0020158 | A1 | 2/2004 | Kopshever, Sr. | |
| 2005/0078049 | A1 | 4/2005 | Trankina | |
| 2005/0183364 | A1 | 8/2005 | Cash | |
| 2006/0272244 | A1 * | 12/2006 | Jensen | 52/223.5 |

* cited by examiner

*Primary Examiner* — Brian D Mattei
(74) *Attorney, Agent, or Firm* — The Webb Law Firm

(57) ABSTRACT

A monopole hollow strengthening tower is provided comprising stages that each comprise a pair of half-pipe sections that fit around the monopole. Each pair of sections is connected to the stage below and to each other. A first stage is connected to the footing of the monopole, a second stage is connected to the top of the first stage and includes cable ports. Subsequent stages extend above the second stage, finally there is a top stage which incorporates a clamping system to grip the monopole. This stage is the only stage above the footing where the monopole and the strengthening tower are in contact with each other. This results in minimisation of outages and disturbances, shortest timeframe, minimum strengthening and avoids significant enlargement of the monopole footprint

16 Claims, 20 Drawing Sheets

| JACKET SECTIONS | | | | | | FLANGE PLATES | | | | | | FLANGE BOLTS | | | GUSSET DETAILS | | | | SEAM PLATES | | | | | |
|---|---|---|---|---|---|---|---|---|---|---|---|---|---|---|---|---|---|---|---|---|---|---|---|---|
| MODULE # | ELEVATION | LENGTH | GRADE | do | tw | GRADE | X | m1 | n | tf | PCD | # BOLTS | ø BOLT | BOLT | GRADE | # GUSSETS | HEIGHT | THK | GRADE | WIDTH | THK | ø BOLT | BOLT | MAX. CTRS |
| | (m) | (mm) | (MPa) | (mm) | (mm) | (MPa) | (mm) | (mm) | (mm) | (mm) | (mm) | | (mm) | (Grade) | (MPa) | | (mm) | (mm) | (MPa) | (mm) | (mm) | (mm) | (Grade) | (mm) |
| 1 (Top + Base) | 0 - 2 | 2000 | 250 | 1000 | 8 | 250 | 25 | 50 | 50 | 25 | 1100 | 28 | M24 | 8.8/S | 250 | 14 | 200 | 8 | 250 | 90 | 8 | M16 | 8.8/S | 300 |
| 3 (Base) | 4-10 | 6000 | 250 | 1000 | 8 | 250 | 25 | 50 | 50 | 25 | 1100 | 24 | M24 | 8.8/S | 250 | 12 | 200 | 8 | 250 | 90 | 8 | M16 | 8.8/S | 300 |
| 3 (Top) | 4-10 | 6000 | 250 | 1000 | 8 | 250 | 25 | 50 | 50 | 25 | 1100 | 20 | M24 | 8.8/S | N/A | N/A | N/A | N/A | 250 | 90 | 8 | M16 | 8.8/S | 300 |

Fig. 8(a)

| JACKET SECTIONS | | | | | | FLANGE PLATES | | | | | | FLANGE BOLTS | | | GUSSET DETAILS | | | | SEAM PLATES | | | | | |
|---|---|---|---|---|---|---|---|---|---|---|---|---|---|---|---|---|---|---|---|---|---|---|---|---|
| MODULE # | ELEVATION | LENGTH | GRADE | do | tw | GRADE | X | m1 | n | tf | PCD | # BOLTS | ø BOLT | BOLT | GRADE | # GUSSETS | HEIGHT | THK | GRADE | WIDTH | THK | ø BOLT | BOLT | MAX. CTRS |
| | (m) | (mm) | (MPa) | (mm) | (mm) | (MPa) | (mm) | (mm) | (mm) | (mm) | (mm) | | (mm) | (Grade) | (MPa) | | (mm) | (mm) | (MPa) | (mm) | (mm) | (mm) | (Grade) | (mm) |
| 1 (Top + Base) | 0 - 2 | 2000 | 250 | 1200 | 8 | 250 | 25 | 50 | 50 | 25 | 1300 | 24 | M30 | 8.8/S | 250 | 12 | 250 | 8 | 250 | 90 | 8 | M16 | 8.8/S | 300 |
| 3 (Base) | 4-10 | 6000 | 250 | 1200 | 8 | 250 | 25 | 50 | 50 | 25 | 1300 | 20 | M30 | 8.8/S | 250 | 10 | 250 | 8 | 250 | 90 | 8 | M16 | 8.8/S | 300 |
| 3 (Top) | 4-10 | 6000 | 250 | 1200 | 8 | 250 | 25 | 50 | 50 | 28 | 1300 | 24 | M24 | 8.8/S | N/A | N/A | N/A | N/A | 250 | 90 | 8 | M16 | 8.8/S | 300 |

Fig. 8(b)

821

| JACKET SECTIONS | | | | | | FLANGE PLATES | | | | | | FLANGE BOLTS | | | GUSSET DETAILS | | | | SEAM PLATES | | | | | |
|---|---|---|---|---|---|---|---|---|---|---|---|---|---|---|---|---|---|---|---|---|---|---|---|---|
| MODULE # | ELEVATION | LENGTH | GRADE | do | tw | GRADE | X | m1 | n | tf | PCD | # BOLTS | ø BOLT | BOLT | GRADE | # GUSSETS | HEIGHT | THK | GRADE | WIDTH | THK | ø BOLT | BOLT | MAX. CTRS |
| | (m) | (mm) | (MPa) | (mm) | (mm) | (MPa) | (mm) | (mm) | (mm) | (mm) | (mm) | | (mm) | (Grade) | (MPa) | | (mm) | (mm) | (MPa) | (mm) | (mm) | (mm) | (Grade) | (mm) |
| 1 (Top + Base) | 0 - 2 | 2000 | 250 | 1200 | 10 | 250 | 25 | 50 | 50 | 25 | 1300 | 32 | M30 | 8.8/S | 250 | 30 | 200 | 10 | 250 | 90 | 10 | M16 | 8.8/S | 300 |
| 3 (Base) | 4-10 | 6000 | 250 | 1200 | 10 | 250 | 25 | 50 | 50 | 28 | 1300 | 32 | M30 | 8.8/S | 250 | 16 | 200 | 10 | 250 | 90 | 10 | M16 | 8.8/S | 300 |
| 3 (Top) | 4-10 | 6000 | 250 | 1200 | 10 | 250 | 25 | 50 | 50 | 25 | 1300 | 28 | M30 | 8.8/S | 250 | 14 | 200 | 10 | 250 | 90 | 10 | M16 | 8.8/S | 300 |

Fig. 8(c)

| JACKET SECTIONS | | | | | | FLANGE PLATES | | | | | | FLANGE BOLTS | | | GUSSET DETAILS | | | | SEAM PLATES | | | | | |
|---|---|---|---|---|---|---|---|---|---|---|---|---|---|---|---|---|---|---|---|---|---|---|---|---|
| MODULE # | ELEVATION | LENGTH | GRADE | do | tw | GRADE | X | m1 | n | tf | PCD | # BOLTS | ø BOLT | BOLT | GRADE | # GUSSETS | HEIGHT | THK | GRADE | WIDTH | THK | ø BOLT | BOLT | MAX. CTRS |
| | (m) | (mm) | (MPa) | (mm) | (mm) | (MPa) | (mm) | (mm) | (mm) | (mm) | (mm) | | (mm) | (Grade) | (MPa) | | (mm) | (mm) | (MPa) | (mm) | (mm) | (mm) | (Grade) | (mm) |
| 1 (Top + Base) | 0 - 2 | 2000 | 250 | 1500 | 10 | 250 | 25 | 50 | 50 | 28 | 1600 | 28 | M30 | 8.8/S | 250 | 14 | 250 | 10 | 250 | 90 | 10 | M16 | 8.8/S | 300 |
| 3 (Base) | 4-10 | 6000 | 250 | 1500 | 8 | 250 | 25 | 50 | 50 | 25 | 1600 | 28 | M30 | 8.8/S | 250 | 14 | 250 | 8 | 250 | 90 | 8 | M16 | 8.8/S | 300 |
| 3 (Top) | 4-10 | 6000 | 250 | 1500 | 8 | 250 | 25 | 50 | 50 | 25 | 1600 | 24 | M30 | 8.8/S | 250 | 12 | 250 | 8 | 250 | 90 | 8 | M16 | 8.8/S | 300 |

Fig. 8(d)

| JACKET SECTIONS | | | | | | FLANGE PLATES | | | | | | FLANGE BOLTS | | | GUSSET DETAILS | | | | SEAM PLATES | | | | | |
|---|---|---|---|---|---|---|---|---|---|---|---|---|---|---|---|---|---|---|---|---|---|---|---|---|
| MODULE # | ELEVATION | LENGTH | GRADE | do | tw | GRADE | X | m1 | n | tf | PCD | # BOLTS | ø BOLT | BOLT | GRADE | # GUSSETS | HEIGHT | THK | GRADE | WIDTH | THK | ø BOLT | BOLT | MAX. CTRS |
| | (m) | (mm) | (MPa) | (mm) | (mm) | (MPa) | (mm) | (mm) | (mm) | (mm) | (mm) | | (mm) | (Grade) | (MPa) | | (mm) | (mm) | (MPa) | (mm) | (mm) | (mm) | (Grade) | (mm) |
| 1 (Top + Base) | 0 - 2 | 2000 | 250 | 1500 | 12 | 250 | 25 | 50 | 50 | 25 | 1600 | 40 | M30 | 8.8/S | 250 | 38 | 200 | 12 | 250 | 90 | 12 | M16 | 8.8/S | 300 |
| 3 (Base) | 4-10 | 6000 | 250 | 1500 | 12 | 250 | 25 | 50 | 50 | 28 | 1600 | 40 | M30 | 8.8/S | 250 | 20 | 200 | 12 | 250 | 90 | 12 | M16 | 8.8/S | 300 |
| 3 (Top) | 4-10 | 6000 | 250 | 1500 | 12 | 250 | 25 | 50 | 50 | 25 | 1600 | 36 | M30 | 8.8/S | 250 | 18 | 200 | 12 | 250 | 90 | 12 | M16 | 8.8/S | 300 |

Fig. 8(e)

| Jacket ID | Jacket Dia. (mm) | Wall Th Module 1 (mm) | Wall Th Module 2 (mm) | Max. Jacket Ht. (m) | Design Shear at 0m | Design Moment at 0m | Design Moment at 2m | Design Moment at 4m | Design Moment at 10m | Design Moment at 16m |
|---|---|---|---|---|---|---|---|---|---|---|
| *A* | 1000 | 8 | 8 | 25 | 80.0 | 1000 | 920 | 840 | 600 | 360 |
| **B** | 1200 | 8 | 8 | 30 | 100.0 | 1500 | 1400 | 1300 | 1000 | 700 |
| **C** | 1200 | 10 | 10 | 35 | 137.1 | 2400 | 2263 | 2126 | 1714 | 1303 |
| *D* | 1500 | 10 | 8 | 35 | 142.9 | 2500 | 2357 | 2214 | 1786 | 1357 |
| *E* | 1500 | 12 | 12 | 40 | 200.0 | 4000 | 3800 | 3600 | 3000 | 2400 |

Fig. 11

STANDARDISED MONOPOLE STRENGTHENING

BACKGROUND OF THE INVENTION

1. Field of the Invention

This invention concerns the construction of telecommunications towers on which transmitters are mounted, and in particular it concerns strengthening for monopole towers.

1. Description of the Related Art

Telecommunications towers are usually tall so that the transmitters and receivers can broadcast and receive over the tops of nearby buildings and hills. There are several different types of towers suitable for mounting transmitters. First, guyed masts that are laterally supported by guy wires. Second, lattice towers that have a wide footprint, taper as they go up and are self-supporting. And third, monopole towers that have a small footprint and are self-supporting.

Ubiquitous wireless communication networks require communications towers to be located throughout populated areas. The location, elevation and concentration of these towers are determined by geographic factors and population density. Communication companies differentiate by providing superior network coverage and capacity. These conditions have led to a market for vertical real estate capable of accommodating communications equipment. This market need has been fulfilled by existing communication towers and in urban areas rooftops. The demand in this market is balanced with costs to build and operate telecommunications towers and local authority delays and community resistance to building new facilities.

As a result, over time more and more equipment tends to be mounted on each existing tower until eventually the maximum structural capacity for a tower may be approached. Due to network operation issues and associated costs tearing down the existing tower and building a new and bigger tower is not an attractive solution. Accordingly, techniques have been developed for strengthening the towers.

Lattice towers and guyed masts are able to be incrementally strengthened, for instance by adding more lattice or additional guy wires, however it is much more difficult to strengthen a monopole.

SUMMARY OF THE INVENTION

The invention is a monopole hollow strengthening tower comprising stages that each comprise a pair of half-pipe sections that fit around the monopole. Each pair of sections are connected to the stage below and to each other. A first stage is connected to the footing of the monopole, a second stage is connected to the top of the first stage and includes cable ports designed for the particular cabling requirement of the monopole. Subsequent stages extend above the second stage, finally there is a 'top stage' which incorporates a clamping system to grip the monopole, and this stage is the only stage above the footing where the monopole and the strengthening tower are in contact with each other. Wherein the footing for the monopole is strengthened by casting a concrete foundation around the existing footing and setting the upper level of the foundation at a first predetermined distance below a lowest cable tray, and wherein the half-pipe sections of the first stage have a height equal to the first predetermined distance; and further wherein the half-pipe sections of a third stage have the same diameter as the half-pipe sections of the first stage.

A bolt cage may be embedded in the new foundation to connect to the first stage of strengthening.

The half-pipe sections for the first stage may be provided in a range of different diameters.

The first predetermined distance, which is 2 m.

The half-pipe sections for the third stage and above, may be provided in a range of different lengths. This provides adequate versatility for the height of the hollow strengthening tower.

The half-pipe sections for the first stage and the third stage may be selected from multiple predetermined types.

The strengthening tower surrounds the monopole, and since it is required to be extremely stiff it may be fabricated from steel or carbon fibre half-pipe sections.

The half-pipe sections may include flanges along their vertical edges for connection to each other. The sections may also have semi-circular flanges around their top and bottom edges for connection to the stages above and below. Webs may be incorporated between the flanges and the outer wall of each section for further stiffening.

The cable ports are located at joints in the half-pipe sections such that the telecommunications cables remain undisturbed, and therefore operational, throughout the strengthening process.

Additional overturning resistance may be provided by means of screw piles, rock anchors or bored piers, that are connected to the concrete foundation.

Only the second stage is customised to the monopole by having portholes for the existing, as well as any new, cable bundles. Since the portholes accommodate the cabling there is no need to disconnect the cables from the monopole when the hollow tower is being built.

The monopole hollow strengthening tower may extend above the monopole.

In a further aspect the invention is a method for strengthening a monopole, by installing a hollow strengthening tower around it, where the hollow strengthening tower comprises a number of stages that each comprises a pair of half-pipe sections that are connected to the stage below and to each other.

The method comprising the following steps:

- Casting a concrete foundation around the existing monopole footing;
- Setting the upper level of the foundation at a first predetermined distance below the lowest cable tray;
- Installing half-pipe sections for the first stage that have a height equal to the first predetermined distance;
- Installing a second stage that is connected to the top of the first stage and includes cable ports designed for the particular cabling requirement of the monopole.
- Installing half-pipe sections of the third stage, which has the same diameter as the first half-pipe sections.
- Finally installing a 'top stage' which incorporates a clamping system to grip the monopole, wherein this stage is the only stage where the monopole and strengthening stages are in contact with each other.

When stages are to be fitted around a part of the monopole that includes equipment, a crane may be used to move the equipment to another part of the tower. After the stages are fitted, the equipment may be returned to its original location, if desired. This minimises downtime for the transmitters during strengthening.

The strengthening technique has been developed to meet the following operational requirements during strengthening:

- Minimisation of outages and disturbances for transmitters on the monopole.
- Shortest timeframe.
- Minimum strengthening to meet the additional strengthening required.

And, avoids significant enlargement of the monopole footprint.

In yet a further aspect the invention is a monopole hollow strengthening tower comprising stages that each comprise a pair of half-pipe sections that fit around the monopole. Each pair of sections are connected to the stage below and to each other. A first stage is connected to the footing of the monopole, a second stage is connected to the top of the first stage and includes cable ports designed for the particular cabling requirement of the monopole. Subsequent stages extend above the second stage. Wherein the footing for the monopole is strengthened by casting a concrete foundation around the existing footing and setting the upper level of the foundation at a first predetermined distance below the lowest cable tray, and wherein the half-pipe sections of the first stage have a height equal to the first predetermined distance; and further wherein the half-pipe sections of the third stage have the same diameter as the first stage.

BRIEF DESCRIPTION OF THE DRAWINGS

An example of the invention will now be described with reference to the accompanying drawings, in which:

FIG. 1(*b*) is an elevation of the lower part of the monopole of FIG. 1(*a*) including its cable bundles.

FIG. 2(*b*) is a pictorial view of the monopole of FIG. 2(*a*) after a first semi-circular strengthening section has been put in place.

FIG. 2(*c*) is a pictorial view of the monopole of FIG. 2(*b*) after a second semi-circular strengthening section has been secured in place; completing a first stage of strengthening.

FIG. 2(*d*) is an elevation of one of the semi-circular strengthening sections of FIG. 2(*b*) and (*c*).

FIG. 2(*e*) is a plan view of the semi-circular strengthening of FIG. 2(*b*) and (*c*).

FIG. 3(*b*) is a pictorial sketch of the semi-circular strengthening sections of FIG. 3(*a*) incorporating port holes for cables.

FIG. 4(*b*) is a pictorial sketch of the arrangement of FIG. 4(*a*).

FIG. 5(*b*) is a plan view of the 'top stage' of FIG. 5(*a*) showing the clamping arrangement.

FIG. 6(*b*) is a pictorial view of the monopole after strengthening and including an additional stage to the strengthening to increase its height.

FIG. 7(*b*) is a plan view of the semi-circular strengthening of the top of the upmost stage of the strengthening tower of FIG. 7(*a*).

FIG. 7(*c*) is a plan view of the semi-circular strengthening of the base of the upmost stage of the strengthening tower of FIG. 7(*a*).

FIG. 7(*d*) is a plan view of semi-circular strengthening of the top of the lowest stage of the strengthening tower of FIG. 7(*a*).

FIG. 7(*e*) is a plan view of semi-circular strengthening of the base of the lowest stage of the strengthening tower of FIG. 7(*a*).

FIG. 7(*f*) is a sectional view of a reinforcing web of FIGS. 2(*d*) and 7(*c*) to 7(*e*).

FIG. 7(*g*) is a detailed view of the mating interface between two semi-circular strengthening sections.

FIGS. 8(*a*) to 8(*e*) are tables of design data for five different types of hollow strengthening towers, each with three stages.

FIG. 9(*b*) is a plan view of one portion of the clamp of FIG. 9(*a*).

FIG. 9(*c*) is a plan view of a clamp guide of FIG. 9(*a*).

FIG. 10(*b*) is a cross-sectional view of the second stage of FIG. 10(*a*).

FIG. 10(*c*) is a detailed view of FIG. 10(*b*).

FIG. 11 is a table of design data for selecting one of the types of hollow strengthening towers of FIGS. 8(*a*) to 8(*e*).

DETAILED DESCRIPTION OF THE INVENTION

Figure 1A:
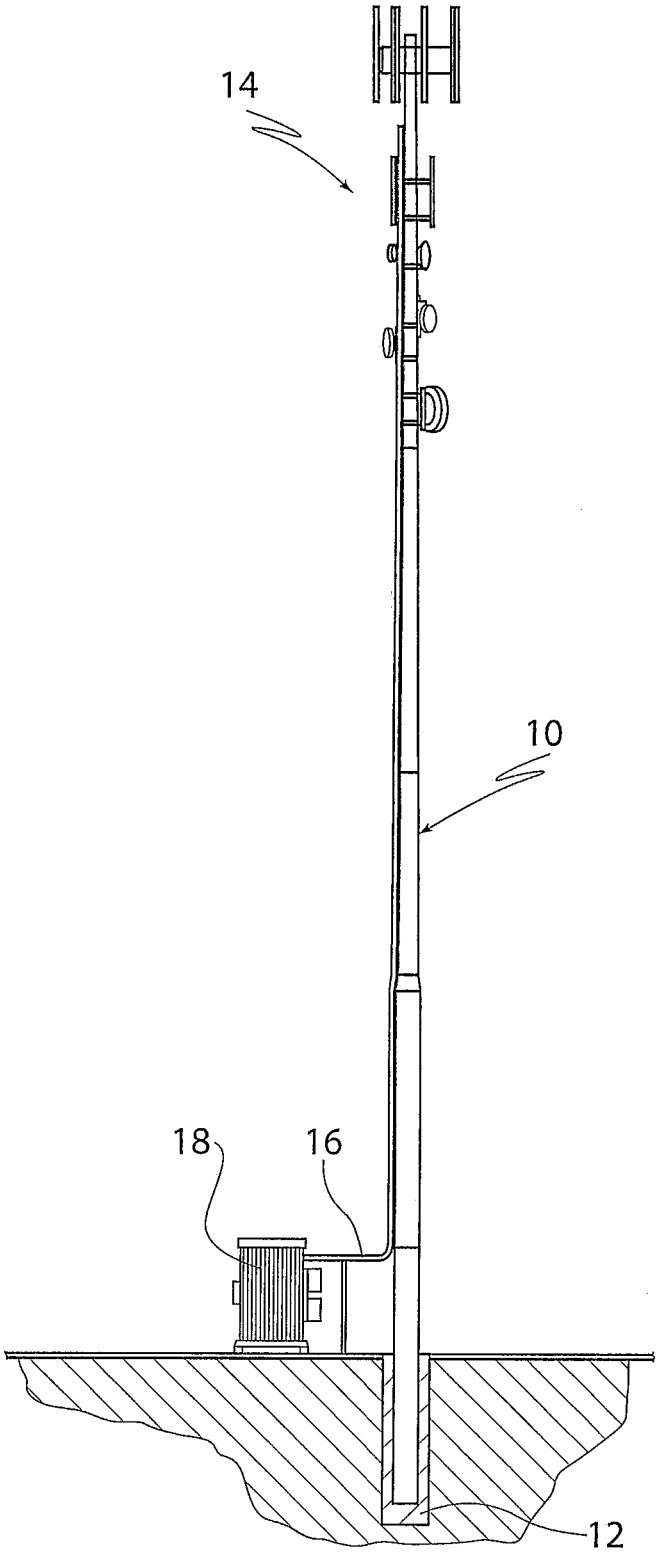
FIG. 1(*a*) is a pictorial view of a monopole including its footing and equipment.
Figure 1B:
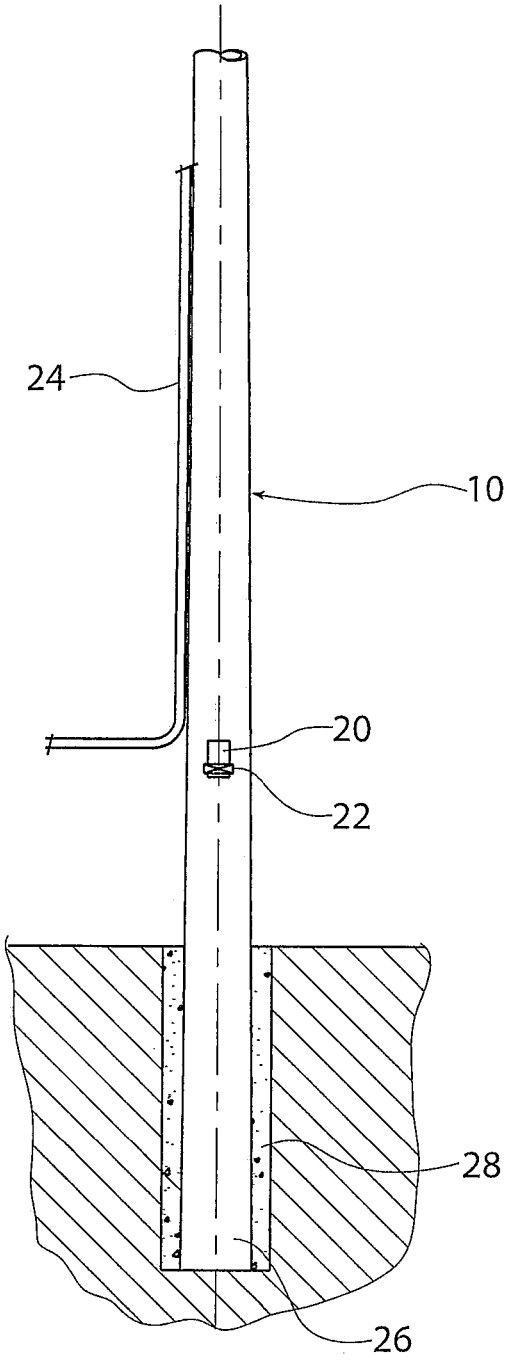
Figure 2A:
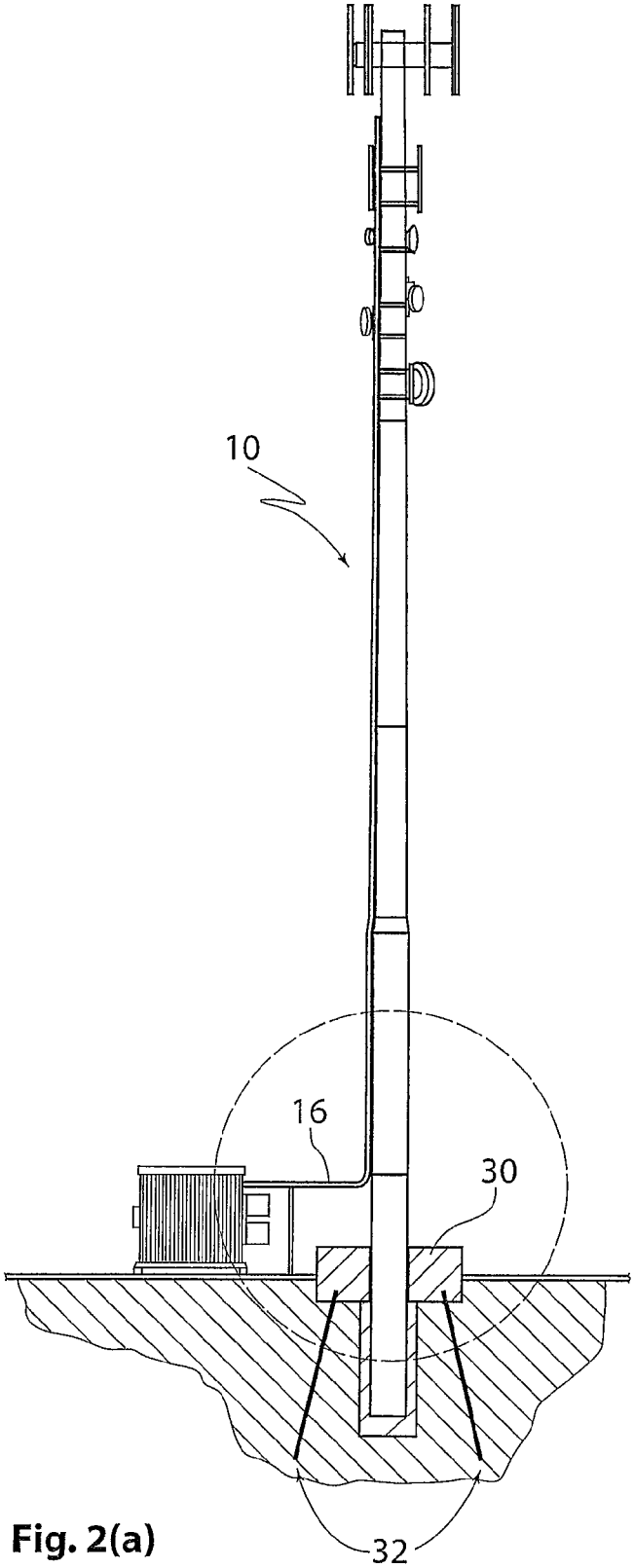
FIG. 2(*a*) is a pictorial view showing an upgraded footing for the monopole of FIG. 1.
Figure 2B:
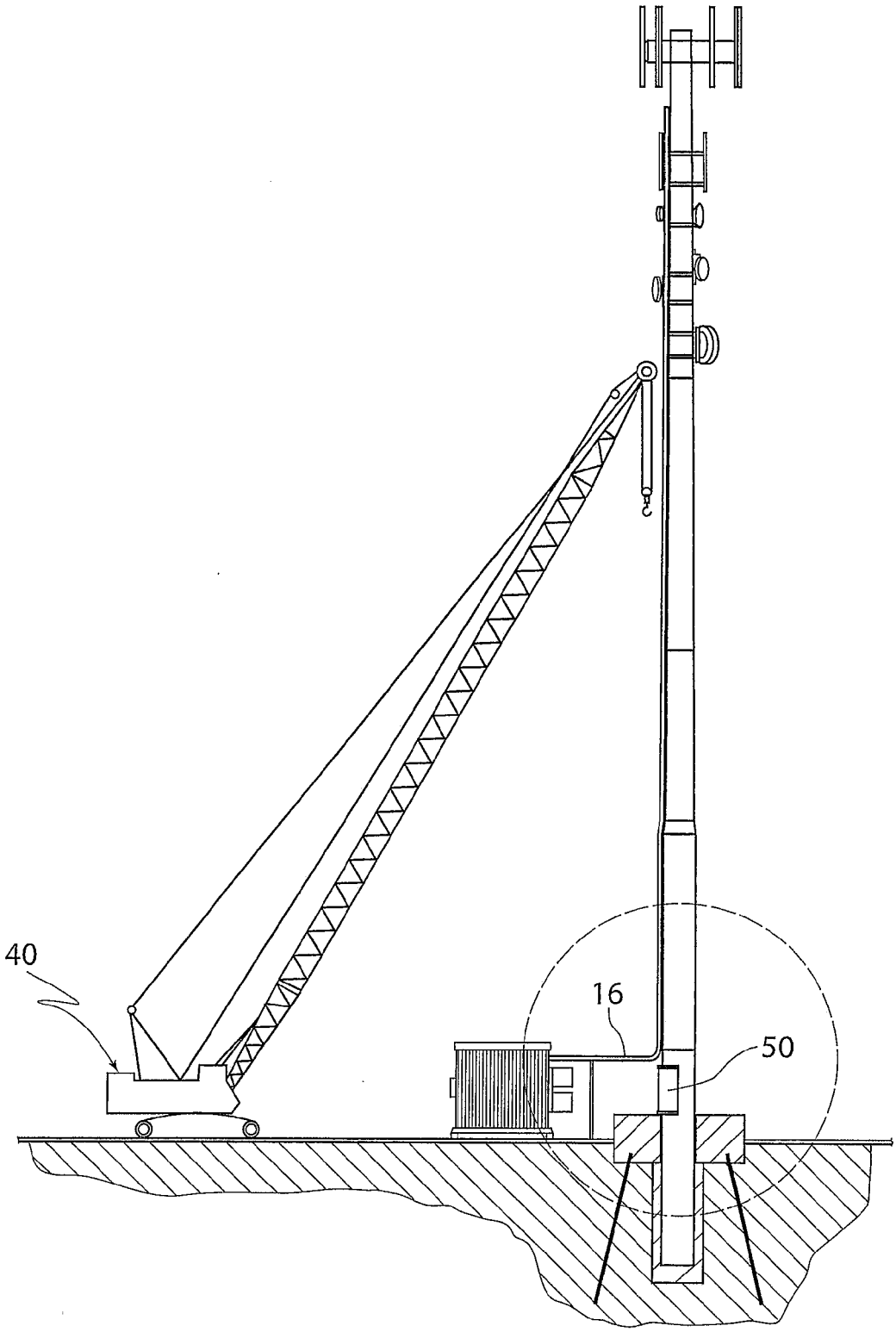
Figure 2C:
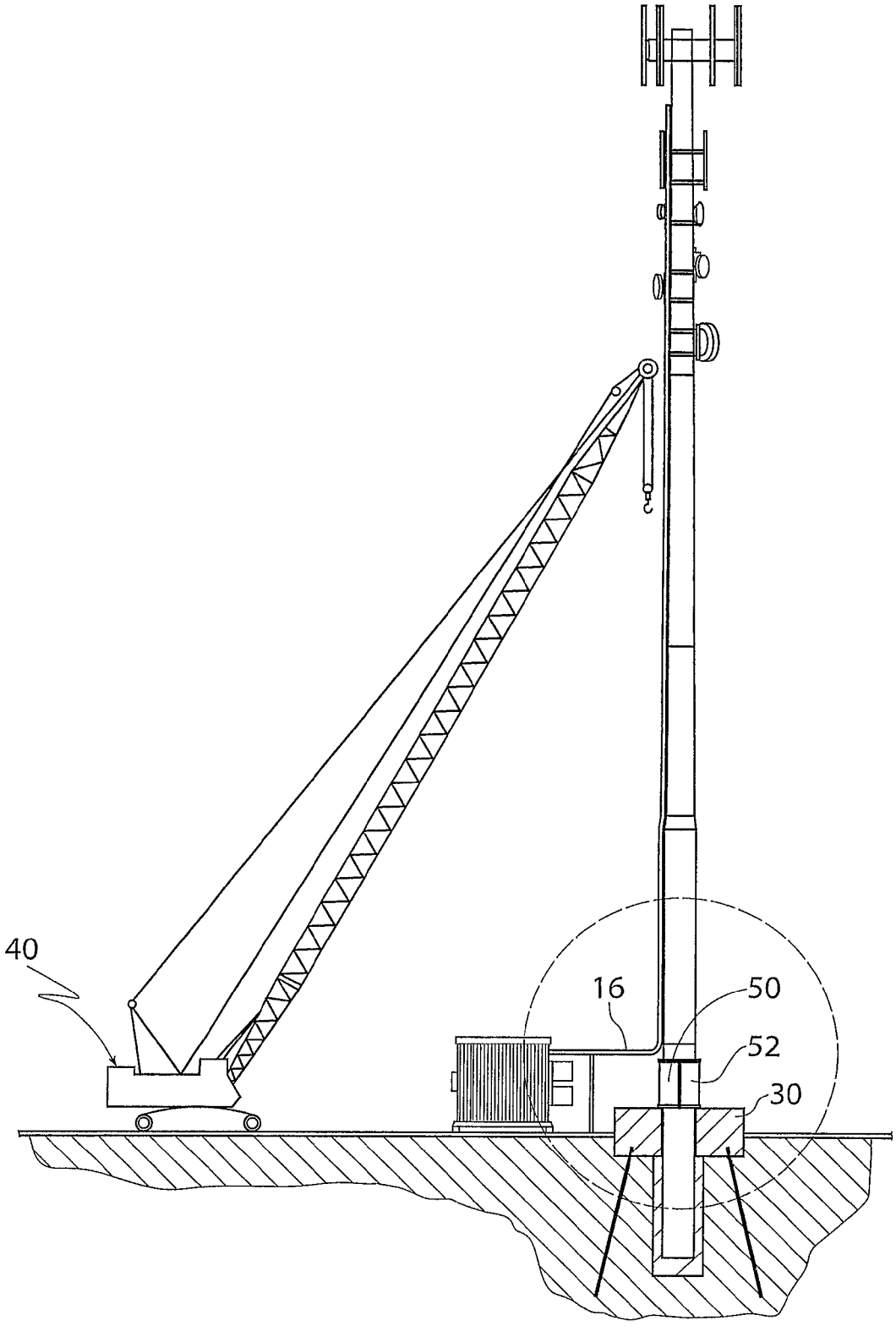
Figure 2D:
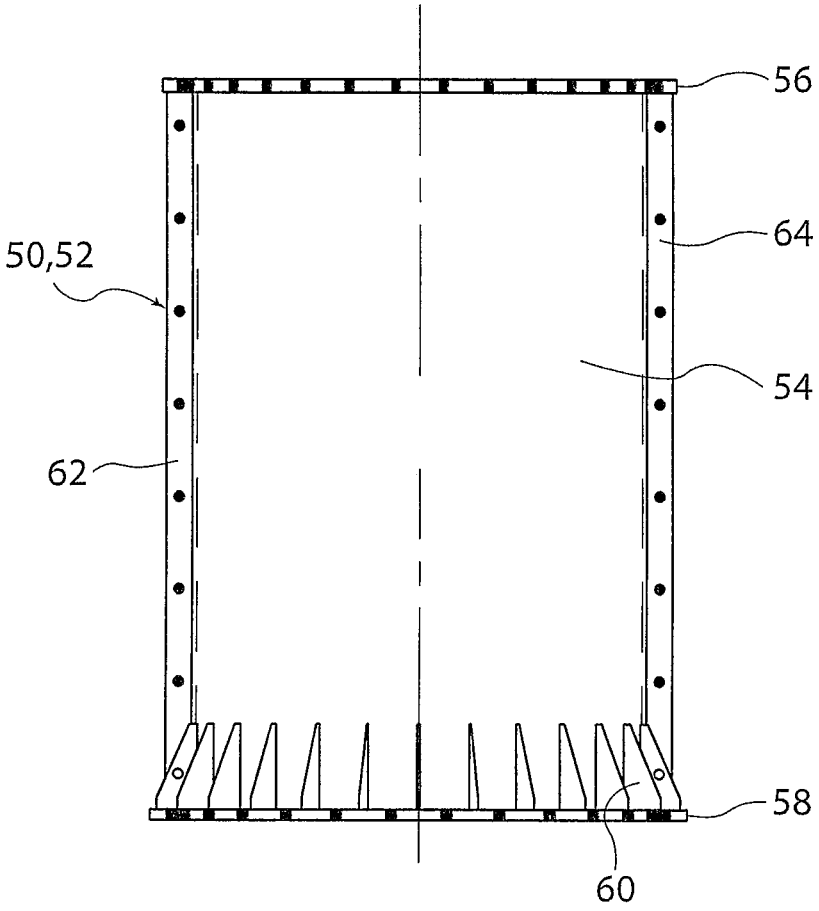
Figure 2E:
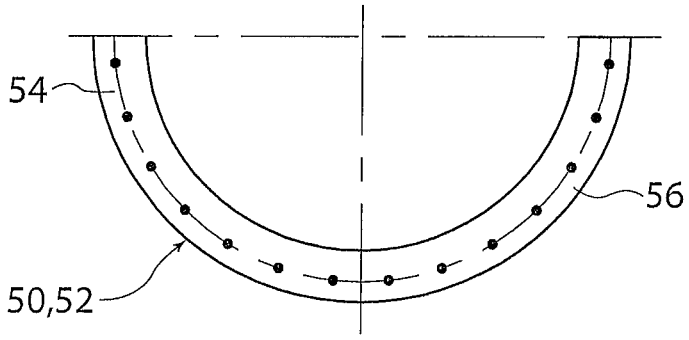

Referring first to FIG. 1(*a*) monopole 10 can be seen to have a subterranean footing 12, and to be equipped with various transmitters 14. The transmitters are fed by cables 16 that run from a cable but 18. The feed to the cable but generally runs in underground ducts. It can be seen that monopole 10 tapers to increasingly narrow sections as it goes up.

There are typically a bundle of cables for each customer who uses the tower. The first customer will typically have their cables running up the interior of the tower, later customers will have their cables running up the exterior of the tower. FIG. 1(*b*) shows a first cable port 20 opening in the tower wall to receive a first cable bundle 22. A second cable bundle 24 runs up the outside of the tower. Underground, the bottom 26 of the monopole 10 is set in a concrete footing 28.

It will be appreciated that the greatest strain on the monopole is near its base. It follows that the first part that might need strengthening is the footing 28. Referring now to FIG. 2(*a*) the interior of the subterranean part of the monopole 26 is filled with concrete. Then a second large concrete foundation 30 is set around the base of the monopole. The upper surface of the foundation is carefully set at a first predetermined distance 'd' below the lowest cable tray 16 that connects to the monopole. The distance 'd' in this example is set to 2 m. All the extra weight in the foundation increases the overturning resistance of the monopole. Rock anchors 32 are bored to the required depth to provide sufficient additional restraint as required. A bolt cage is (34 in FIG. 4 (*b*)) is installed at the upper end of foundation 30.

Next, a stiff hollow strengthening tower 120 is constructed around monopole 10. The hollow tower is placed around the monopole in stages with the first stage being placed on foundation 30. Each stage has two 'half-pipe' sections which are semicircular in horizontal section. They are placed around the monopole using a crane 40.

The first section 50 of the hollow strengthening tower 120 is shown in place in FIG. 2(*b*). This section 50 has a height equal to 'd', that is 2 m, so that it fits below cable tray 16 when it rests on top of foundation 30. Its mating section 52, which is also 2 m high, is shown in place in FIG. 2(*c*); which completes the first stage 50 of the tower. FIGS. 2(*d*) and (*e*)

show that each section of the first stage has a semi-circular wall 54 with a top flange 56 and a lower flange 58. These sections may have a limited range of different diameters, for instance 1600 mm for wide towers and 1200 mm for narrow towers. Reinforcing webs 60, such as gussets, are positioned around the bottom of the sections between the lower flange 58 and the wall 54 to increase stiffness.

Vertical flanges 62 and 64 run up the edges of each section so they can be fastened together. The sections are bolted to each other and to the bolt cage (34 in FIG. 4 (*b*))in foundation 30.

It will be seen from FIGS. 2 that the first sections 50 and 52 are a predetermined length and the upper surface of the foundation set to a height such that the first section of hollow tower stops below the height where cables 16 arrive at the monopole 10.

Figure 3A:
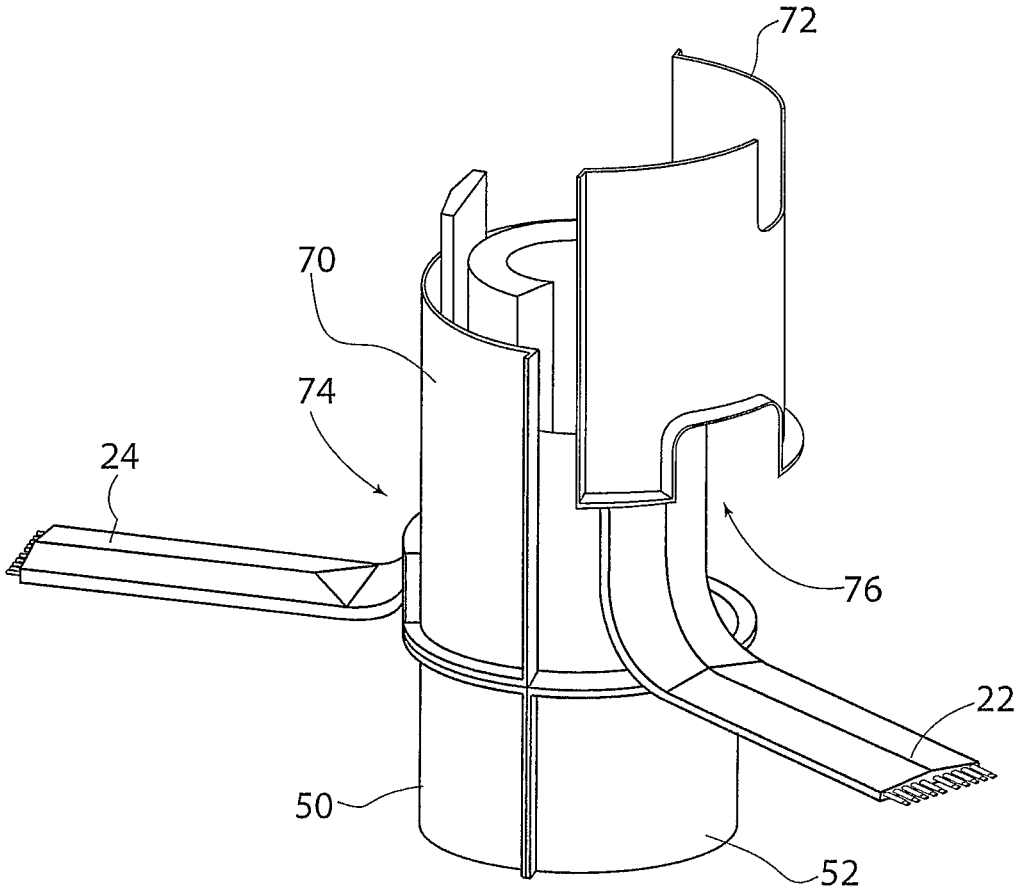
FIG. 3(*a*) is a pictorial view of a further pair of semi-circular strengthening sections incorporating portholes for cables.
Figure 3B:
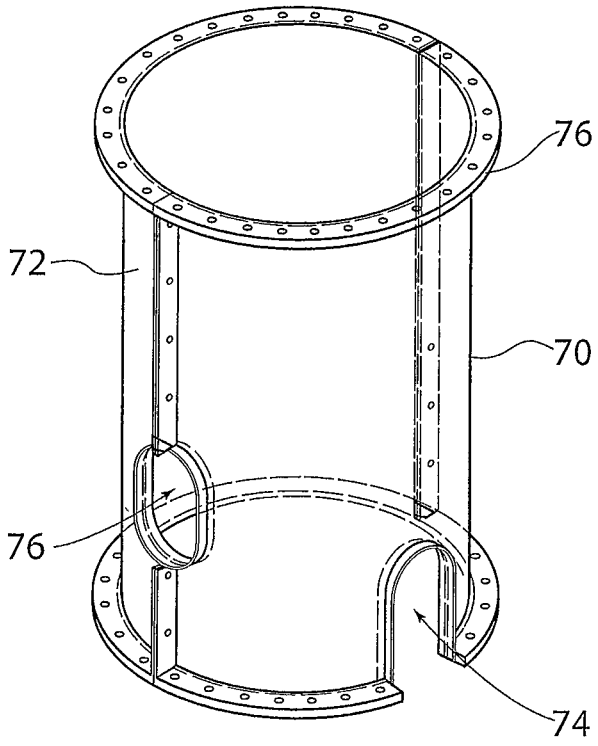

Referring now to FIGS. 3, the second stage sections 70 and 72 of strengthening tower 120 have custom portholes to allow the cable bundles to enter under the hollow tower 120. Section 70 has a porthole 74 opening at the bottom, and both sections 70 and 72 have half of a mating porthole 76 that is formed when they are connected together. Sections 70 and 72 are also bolted to sections 50 and 52 of the first stage. Cable tray 24 belonging to the first customer enters through port hole 74 and goes into the interior of monopole 10. The second customer's cable tray 22 enters porthole 76 slightly higher up the monopole 10 and runs up the outside of the monopole. The location of the portholes is such that the existing cable trays can remain in place. This further reduces the cost for installing the strengthening.

Figure 4A:
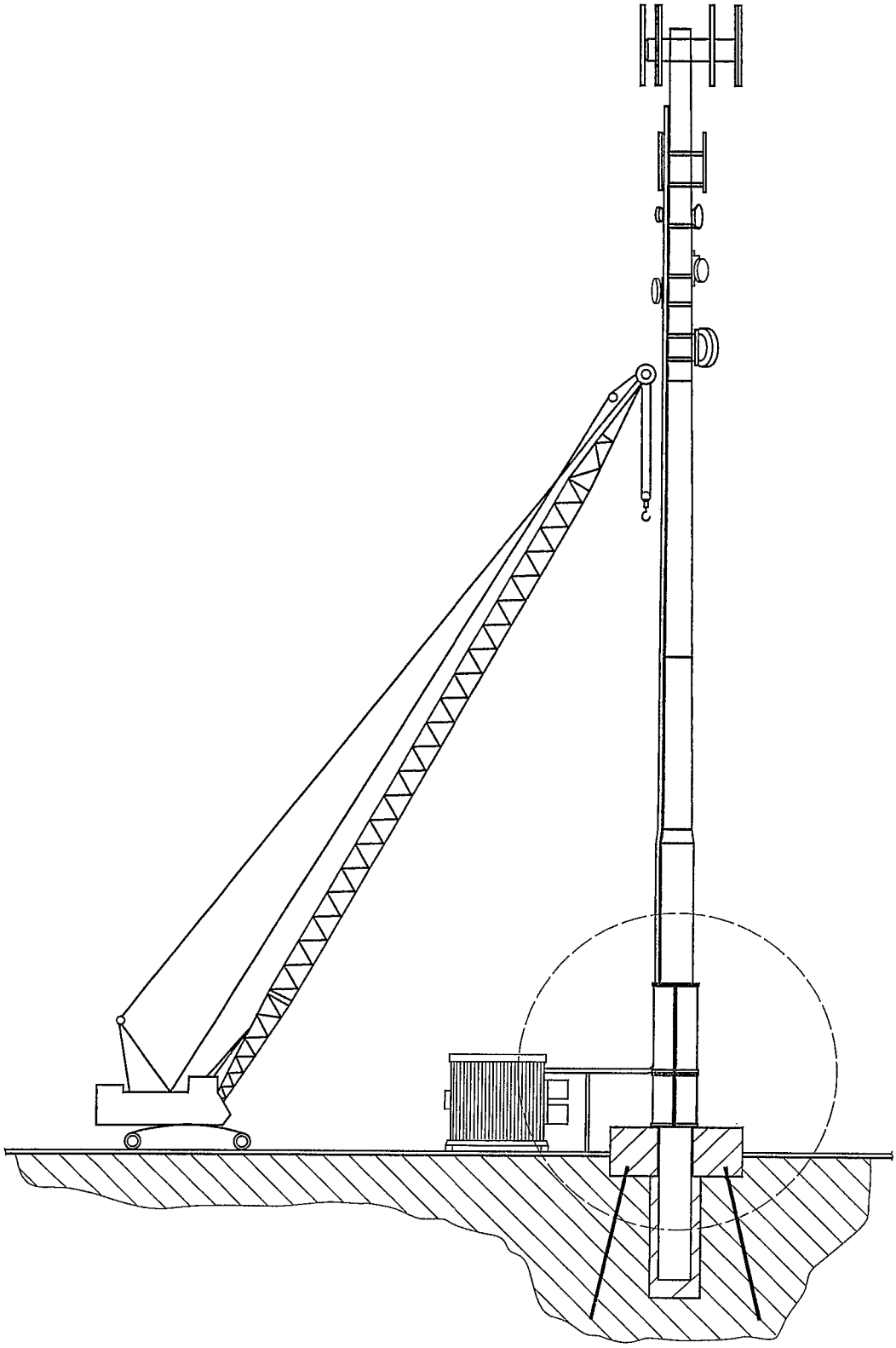
FIG. 4(*a*) is a pictorial view of the monopole fitted with the strengthening sections of FIGS. 2 and 3.
Figure 4B:
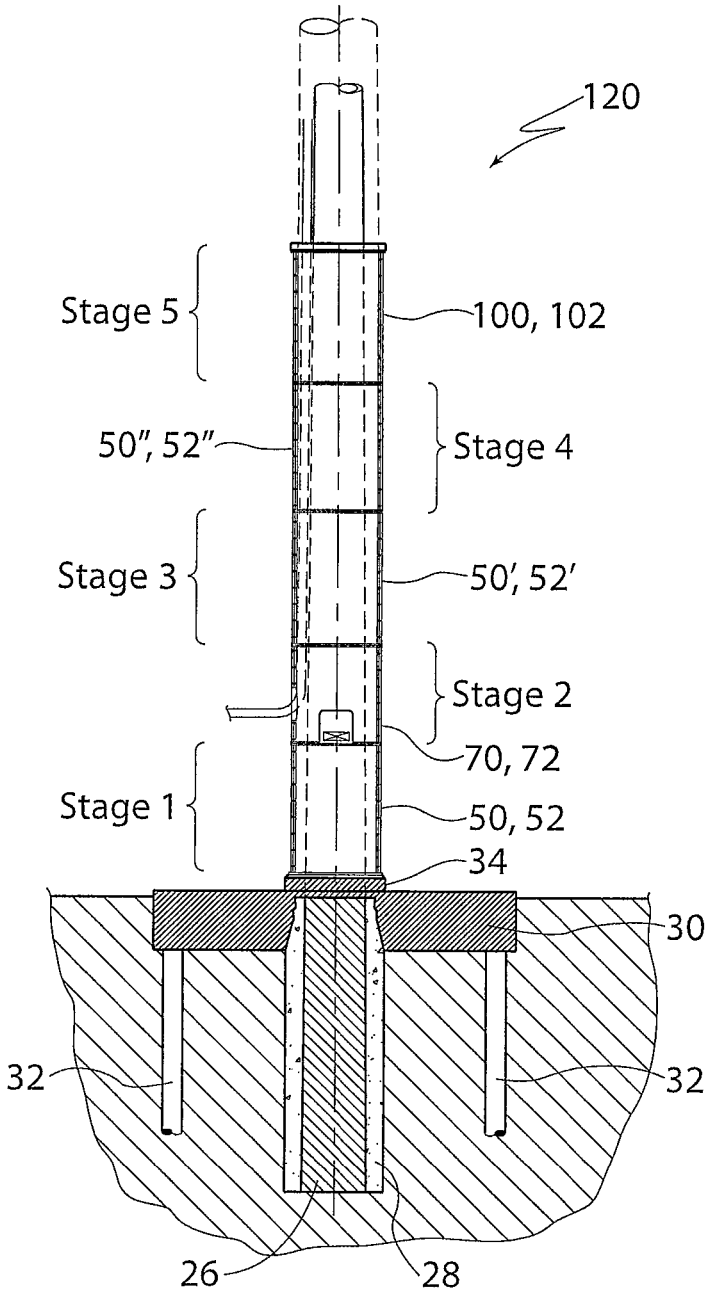

Referring now to FIGS. 4, above the cable portholes a third stage 50'/52' are selected from a catalogue of standard hollow strengthening tower sections as will be described with reference to FIGS. 7(*a*) and 8(*e*). These will have the same diameter as the first stage, but may vary in length, for instance being 3 in or 6 m high, depending on the height to which the strengthening tower 120 is required. This stage has no portholes. It can be clearly seen in FIG. 4(*b*) that the hollow tower does not contact the surface of the monopole 10. In fact while the monopole 10 tapers as it rises, the hollow strengthening tower 120 remains the same diameter from bottom to top.

FIG. 4(*b*) also shows a fourth stage 50"/52" and a fifth stage 100/102 of the strengthening tower 120 fitted around the monopole 10. This stage is also selected from a catalogue of standard hollow strengthening tower sections, and in this case are identical to the third stage 50'/52'.

Figure 5A:
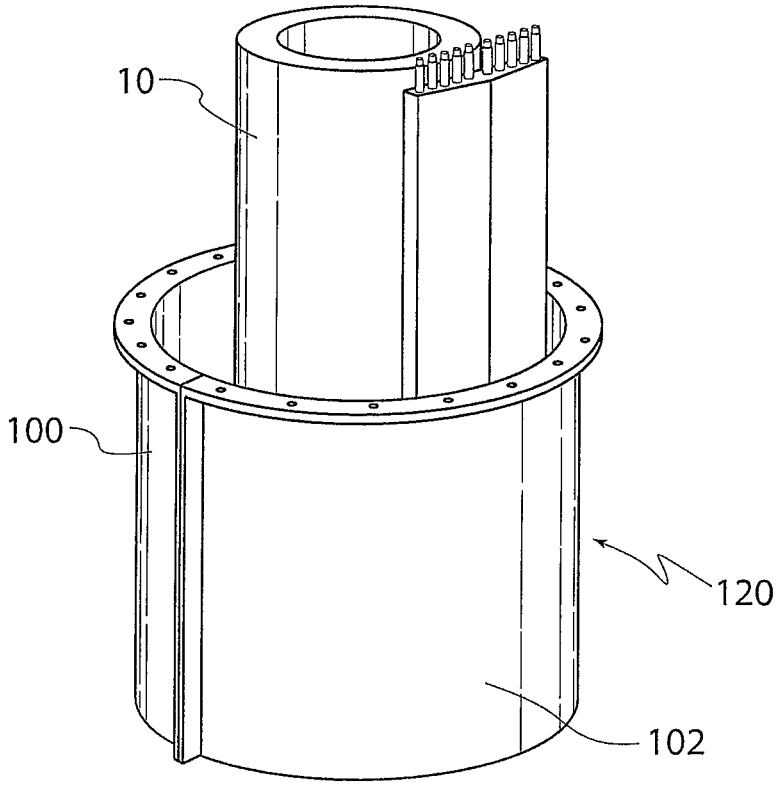
FIG. 5(*a*) is a pictorial view of a 'top stage' for the strengthening, which is clamped to the monopole.
Figure 5B:
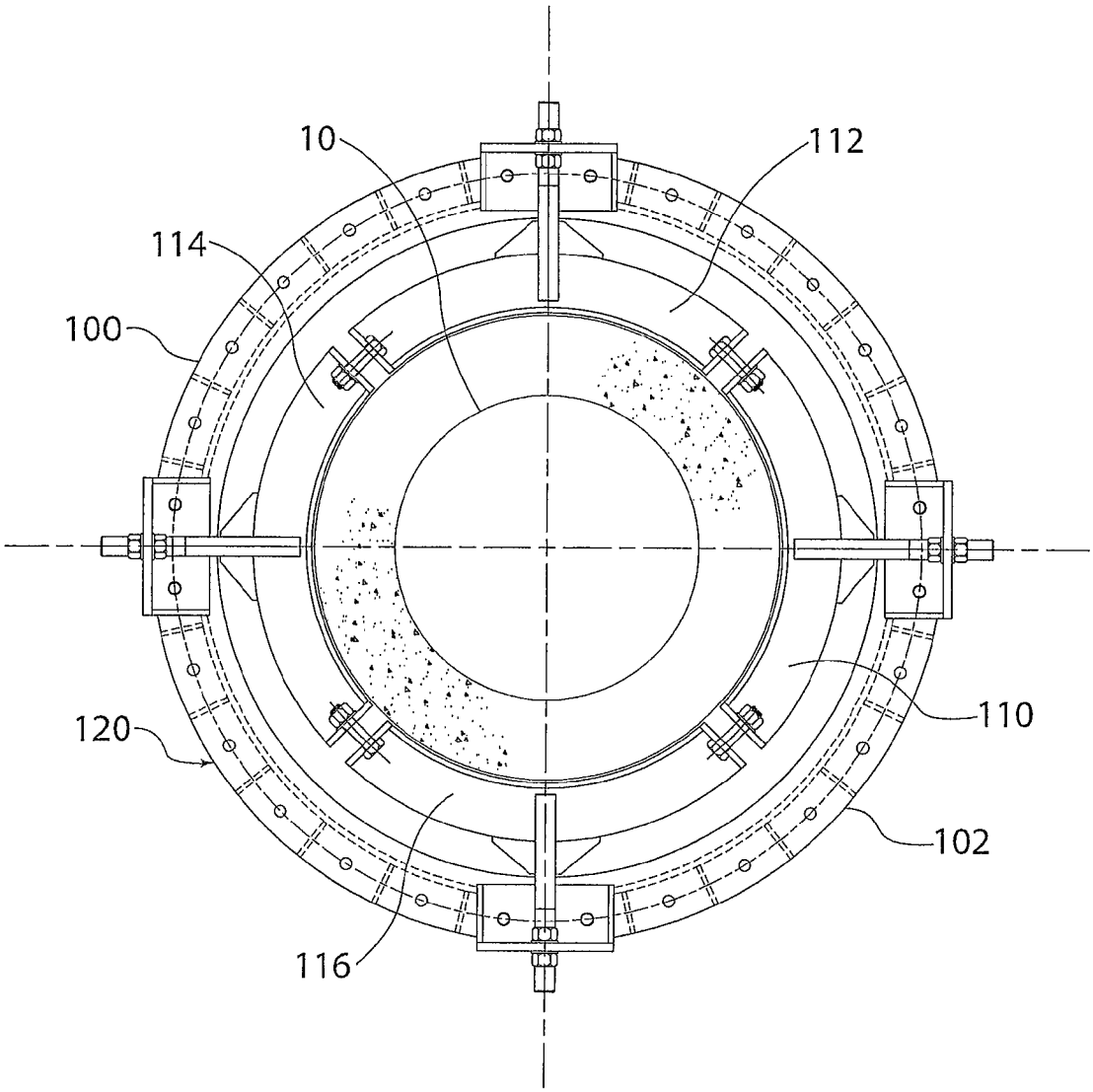

FIGS. 5(*a*) and (*b*) show a 'top stage' 100/102 which is fitted around the monopole at the top of strengthening tower 120. The top stage has a top flange 101 that carries four clamps 110, 112, 114 and 116 that grip the outside of monopole 10. This is a 'pinned' connection that provides 'propped' support and changes the existing cantilever structure of the monopole 10 into a 'propped' cantilever structure. The majority of any force caused by bending in the monopole 10 is transferred through this 'pinned' connection to the hollow strengthening tower 120.

The height at which the 'top stage' 100/102 is clamped to the monopole 10, is determined by the degree of strengthening required. For instance, when a monopole is loaded to its design capacity and new equipment is to be installed, then the top stage 100/102 will be installed to the height required for that degree of strengthening. When further equipment is required then the clamps will be taken off, one or more new stages of the hollow tower are added, and then the clamps are reinstalled at a greater height; giving greater strength. This can happen several times during the life of a monopole. The clamps 110, 112, 114 and 116 are adjustable so that they can accommodate to clamp different diameters of the monopole. This allows the same clamps to be used and re-used at a different height. In one example, the hollow strengthening extends further than the monopole and therefore results in a higher tower than the monopole itself.

Figure 6A:
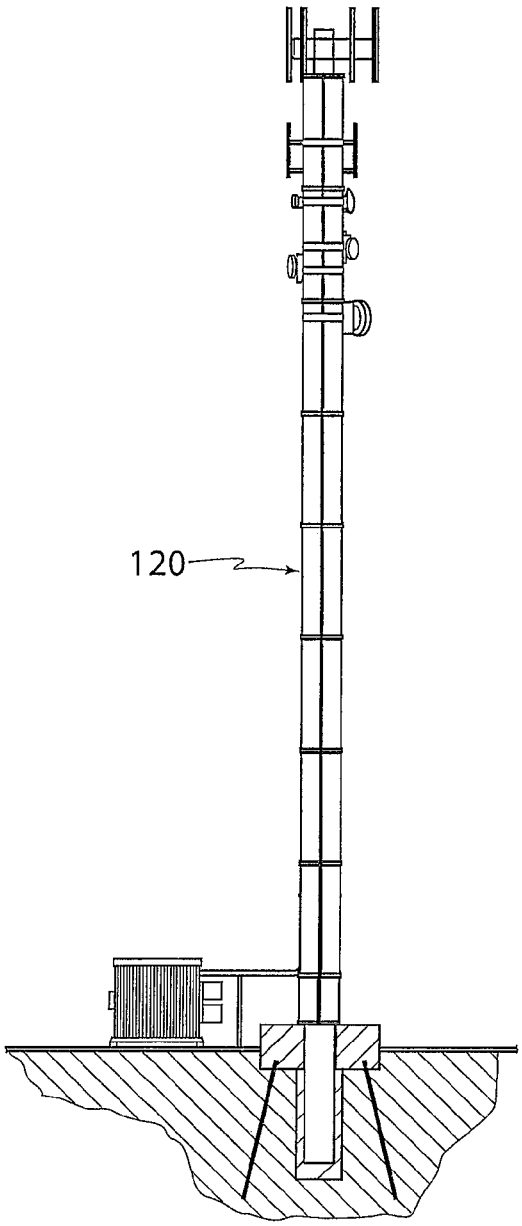
FIG. 6(*a*) is a pictorial view of the monopole after the strengthening has been completely installed.
Figure 6B:
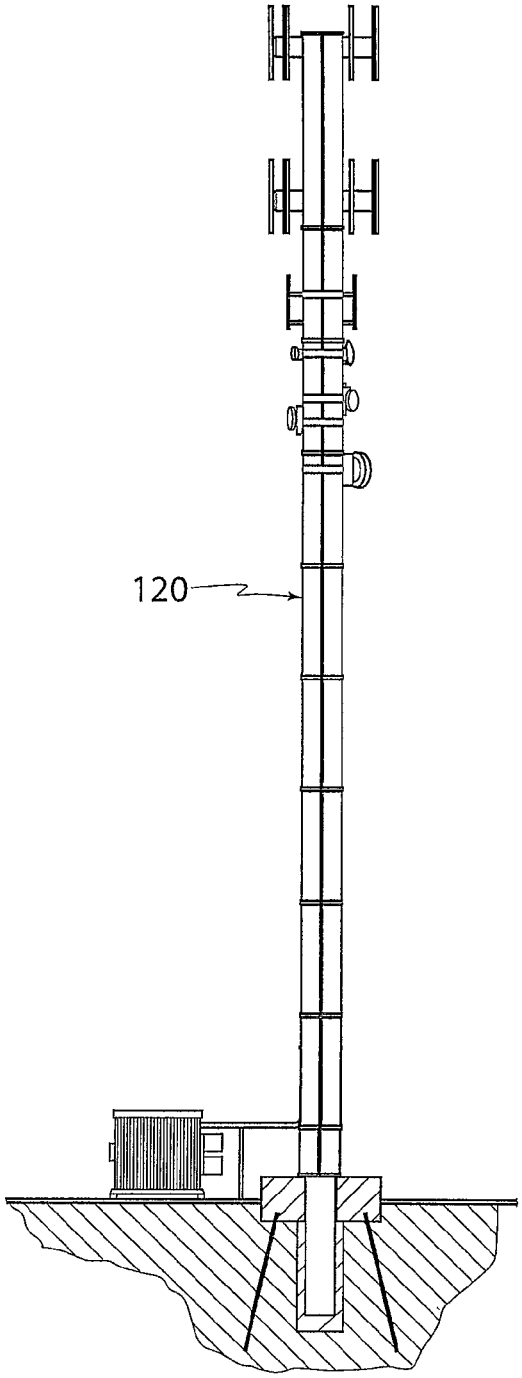
Figure 7A:
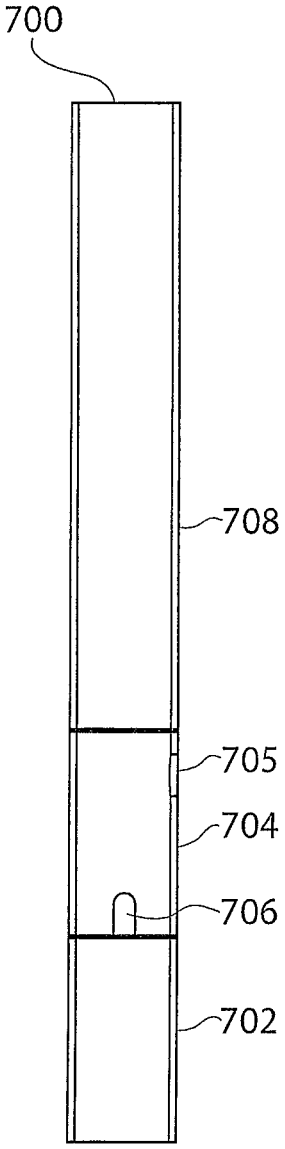
FIG. 7(*a*) is an elevation of a strengthening tower comprising three stages.
Figure 7B:
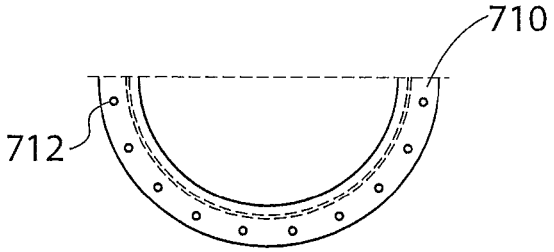
Figure 7C:
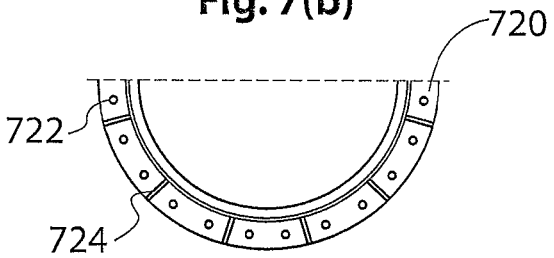
Figure 7D:
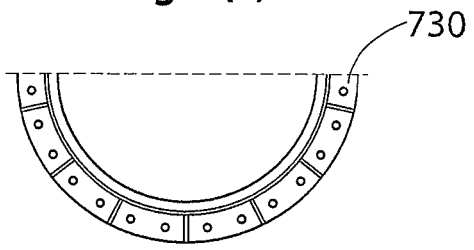
Figure 7E:
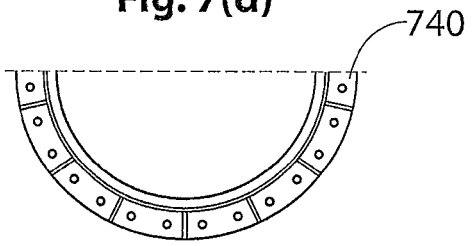
Figure 7F:
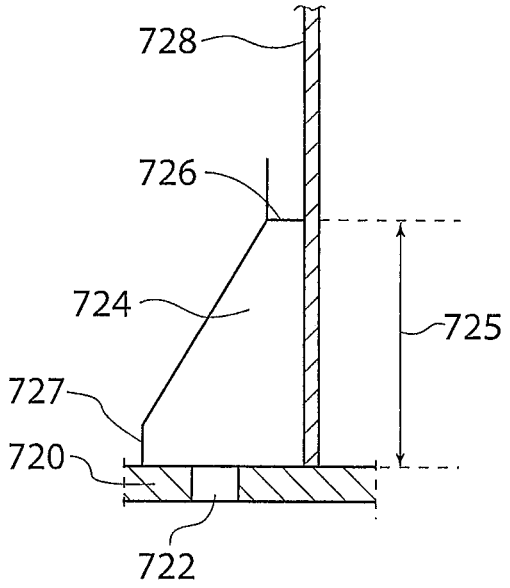
Figure 7G:
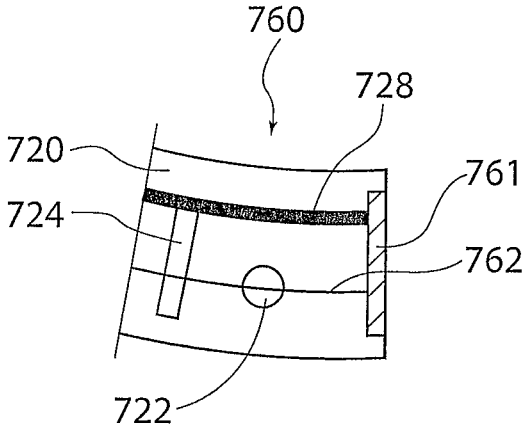

FIG. 6(*a*) shows a monopole 10 that is completely encased by hollow tower 120. FIG. 6(*b*) shows a hollow tower 120 that extends above the existing monopole. In one example, the hollow tower 120 extends above the monopole and stands on its own, that is it is not clamped to the monopole 10.

FIG. 7(*a*) illustrates another example of a strengthening tower 700 comprising a lower stage 702, a feeder entry stage 704 including a first porthole 705 and a second porthole 706, and a top stage 708. The stages 702, 704 and 708 are taken from a catalogue of standard strengthening towers. In this example, the lower stage 702 extends from 0 m to 2 m, the feeder entry stage 704 from 2 m to 4 m and the top stage from 4 m to 10 m above ground level. The three stages 702, 704 and 708 are also referred to as modules or jacket sections.

FIG. 7(*b*) illustrates the semi-circular strengthening 710, such as a flange, at the top of the top stage 708. The flange 710 has multiple holes 712 for affixing the brackets 110, 112, 114 and 116 of FIG. 5(*b*) to the flange 710. In this example, the flange 710 has ten equally spaced holes 712 but a different number of holes is possible according to the standard design data in FIGS. 8(*a*) to 8(*e*) for five different standard types of steel jackets. For example, FIG. 8(*b*) gives design data of a type B steel jacket. This data contains "24" (row labelled "3 (Top)" and column labelled "FLANGE BOLTS/#BOLTS") as an example for the number of bolts 821 in FIG. 8(*b*) for the entire circumference, that is 12 holes in each semi-circular flange.

The diameter of the holes is such that the diameter of the holes corresponds to the diameter of bolts used, as given in FIGS. 8(*a*) to 8(*e*). For example, a 26 mm hole is used for a 24 mm (M24) bolt and a 33 mm hole is used for a 30 mm (M30) bolt.

FIG. 7(*c*) illustrates a flange 720 of the base of the top stage 708 of the strengthening tower 700. Similar to flange 710 in FIG. 7(*b*), the flange 720 comprises holes 722, where the number and diameter of holes is given for different jacket types in the standard design data in FIGS. 8(*a*) to 8(*e*) in rows labelled "3 (Base)". In addition to the features of flange 710 in FIG. 7(*b*), flange 720 is reinforced by reinforcing webs, such as gusset plates 724.

FIG. 7(*f*) illustrates gusset plate 724 in sectional view. The gusset plate 724 has the shape of a right triangle with the three corners cut off. The height 725 is defined as the length of the cathetus that extends along the steel jacket and is given in FIGS. 8(*a*) to 8(*e*). In one example, the other measurements of the gusset plate do not change between different jacket types. That is, the top horizontal edge 726 and the lower vertical edge 727 are both 20 mm long while the gusset plate 724 is set back from the external edge the flange 720 by 10 mm.

The gusset plate is welded to the flange 720 and the wall 728 of the steel jacket 708. The thickness of the wall 728 is denoted as "tw", while the exterior diameter of the wall 728 is denoted as "do" in the tables in FIGS. 8(*a*) to 8(*e*). In this example, the centre of hole 722 is spaced apart from the exterior surface of the wall 728 by 50 mm ("m1") and the flange extends outwardly from the centre of hole 722 by 50 mm ("n"). The flange 720 extends inwardly by 25 mm ("x") from the exterior surface of wall 728 into the interior of jacket 708.

FIG. 7(*d*) and FIG. 7(*e*) illustrate flanges 730 and 740 of the top and base of the lowest stage 702 of the strengthening tower of FIG. 7(*a*), respectively. The number of holes and gusset plates, as well as other standard design data is presented in the tables in FIGS. 8(*a*) to 8(*e*) in row labelled "1 (Top+Base)".

In this example, the wall thickness of the feeder entry stage 704 matches the wall thickness of lowest stage 702. The configuration of the top and base flanges of feeder entry stage 704, including number of holes and design of gusset plates, is such that the configuration matches that of the bottom flange of top stage 708 and the top flange of the lowest stage 702, respectively.

FIG. 7(*g*) is a detailed view of a mating interface 760 between two semi-circular strengthening sections. In the following description of the mating interface 760, the reference numerals of the base flange 720 of the top stage 708 are used but the same design may be applied to the other stages 702 and 704. FIG. 7(*g*) depicts the flange 720 having hole 722, gusset plate 724 and wall 728. A seam plate 761 is welded to the flange 720 and the wall 728, such that the seam plate extends vertically between the top and the base flange of the top stage 708. The edge of flange 720 and the exterior surface of seam plate 761 define a smooth surface, such that two identical semi-circular strengthening sections can abut without forming any gaps between them.

A pattern of multiple vertically align holes, such as hole 762, extends along the seam plate 761, the centre of hole 762 being located outwardly from the exterior surface of wall 728 by 35 mm. The seam plate extends inwardly from the exterior surface of wall 728 by 20 mm. When in use, two semi-circular strengthening sections 70 and 72 in FIG. 3(*b*) are bolted together through holes 762 in the seam plate 761.

Figure 9A:
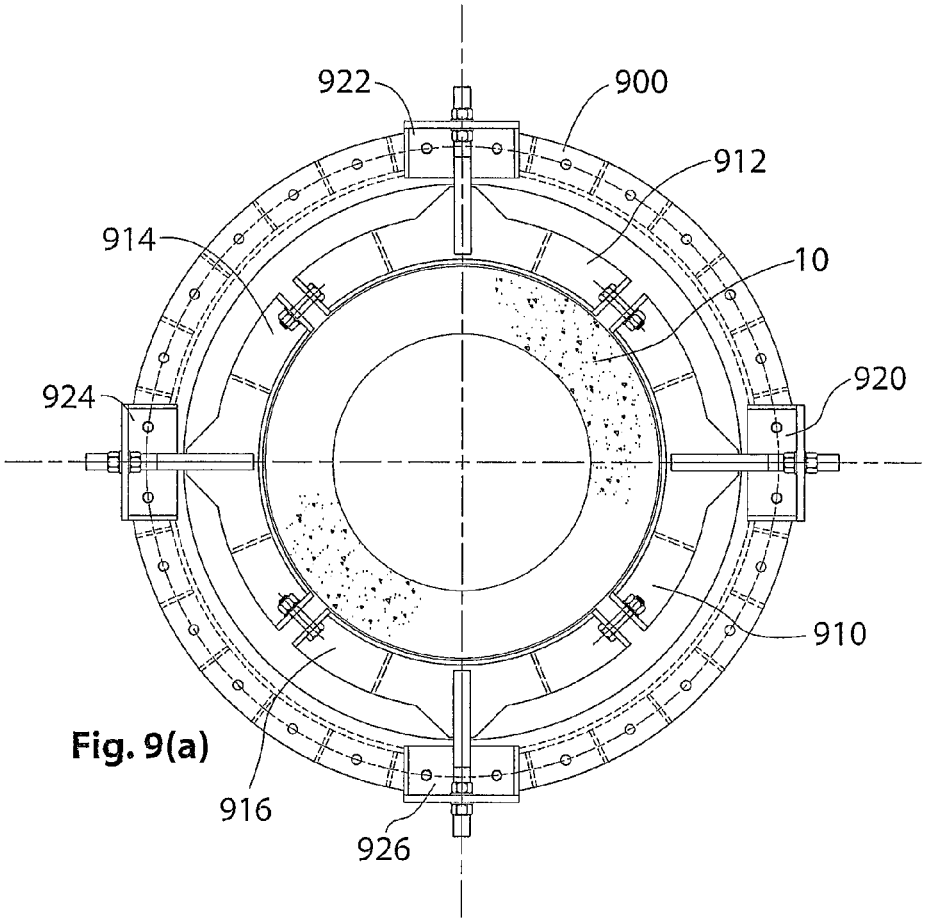
FIG. 9(*a*) is a plan view of the 'top stage' of FIG. 5(*a*) showing another example of the clamping arrangement.
Figure 9B:
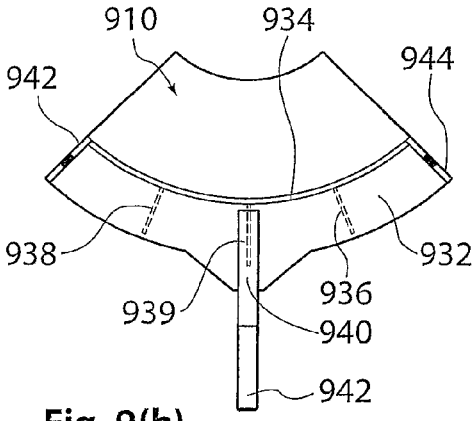
Figure 9C:
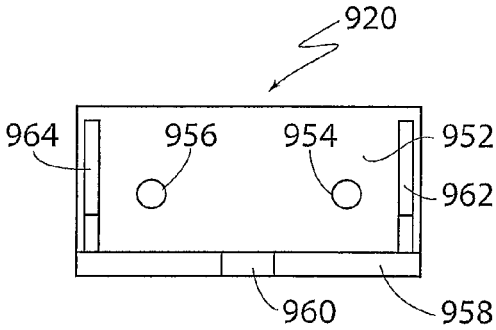

FIG. 9(*a*) shows another example of the 'top stage' 900. This example of top stage 900 is similar to the example described with reference to FIG. 5(*b*) in that the top stage 900 comprises four clamps 910, 912, 914 and 916 that form a pinned connection with the monopole 10. One difference to FIG. 5(*b*) is the design of clamps 910, 912, 914 and 916 which will now be described with reference to FIG. 9(*b*).

FIG. 9(*b*) shows one of the four clamps 910 in more detail. The clamp 910 comprises a horizontal, arcuate clamp plate 932 that supports an downwardly extending bearing plate 934 for engaging the monopole 10. The connection between the clamp plate 932 and the bearing plate 934 is reinforced by reinforcement gussets 936 and 938, which are, in this example, arranged such that they are equally distanced from the centre of the clamp plate 932 and one end of the clamp plate 932. A third reinforcement gusset 939 is located at the centre of the clamp plate 932.

At the centre of the clamp plate 932, there is a outwardly extending round bar 940 attached to the top surface of the clamp plate 932. The round bar 940 has a thread 942 at the outward end. When in use, the round bar 940 is received by clamp guide 920 in FIGS. 9(*a*) and 9(*c*).

The clamp 910 further comprises two vertical coupling plates 942 and 944 located at opposed ends of the clamp plate 932. Each of the coupling plates 942 and 944 has a central hole for receiving a bolt that connects two adjacent clamps as shown in FIG. 9(*a*).

FIG. 9(*c*) shows the clamp guide 920 in more detail. The clamp guide 920 comprises a horizontal rectangular base plate 952 with two holes 954 and 956. The distance between the holes 954 and 956 and their diameter correspond to the distance and diameter of holes 712 in top flange 710 as described with reference to FIG. 7(*b*). The clamp guide 920 further comprises a vertical interface plate 958 with a central hole 960 for receiving the round bar 940 of the clamp 910. The connection between the interface plate 920 and the base plate 952 is reinforced by reinforcement gussets 962 and 964.

When in use, the clamp guide 920 is located on the top flange 710 of the top stage 708 such that the holes 954 and 956 align with the holes 712 of the top flange 710 and such that the interface plate 958 is facing outwardly. Two bolts as specified in FIGS. 8(*a*) to 8(*e*) are inserted into the holes 954 and 956 and through the holes 712 of the top flange 710. The bolts are then secured by corresponding nuts.

Once the clamp guide 920 is installed, the round bar 940 of clamp 910 is inserted into hole 960 of clamp guide 920 and secured with a nut from the outside to secure the clamp against moving inwardly. In one example, a second nut is screwed on the round bar 940 before the round bar 940 is inserted into hole 960 to also secure the clamp 910 against moving outwardly. Both nuts are then tightened such that the interface plate 958 is tightly held between the two nuts.

In another example, the round bar 940 is inserted into the hole 960 of clamp guide 920 before the clamp guide is affixed to top flange 710. This may be the case if the dimensions of the monopole and the clamp 910 are such that there is not enough space to mount the clamp 910 after installing the clamp guide 920.

The other clamps 912, 914 and 916 are installed in a similar manner such that the monopole is held by a pinned connection between the four claps 910, 912, 914 and 916. In different examples, the number of clamps may not be four but any other suitable number, such as three or eight.

Figure 10A:
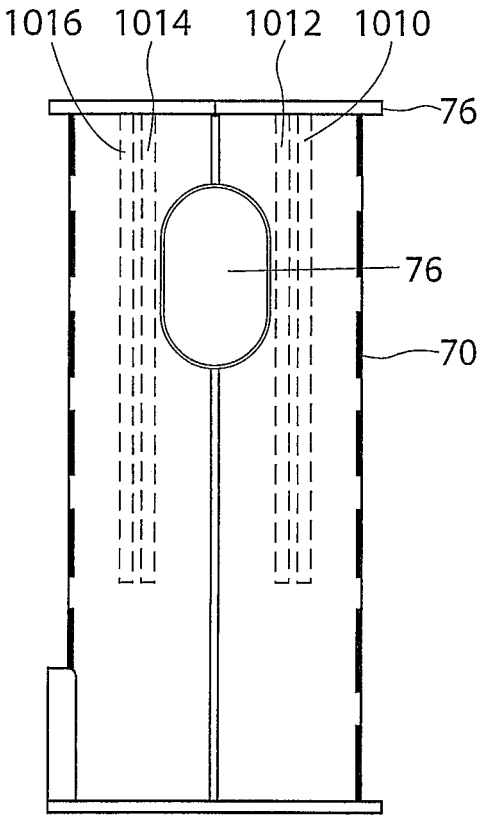
FIG. 10(*a*) is an elevation of the second stage of FIG. 3(*b*) showing an example of the porthole for cabling.
Figure 10B:
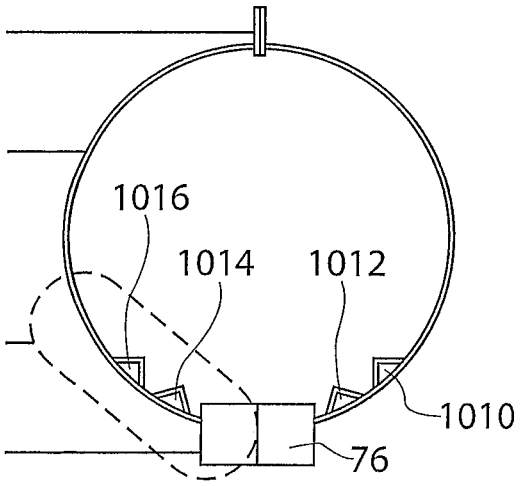
Figure 10C:
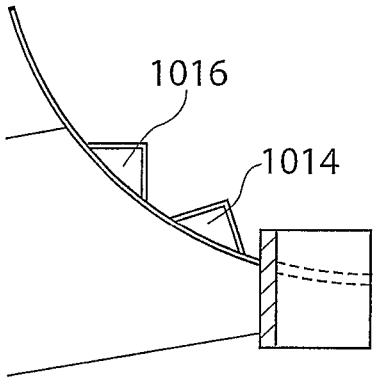

FIG. 10(*a*) shows another example of the second stage 70 in FIG. 3(*b*). As described with reference to FIG. 3(*b*), the second stage 70 comprises porthole 76. In the example of FIG. 10(*a*) the second stage 70 further provides longitudinal reinforcement webs 1010, 1012, 1014 and 1016. The reinforcement webs 1010, 1012, 1014 and 1016 compensate for the loss in integral stability caused by inserting the porthole into the second stage 70.

FIG. 10(*b*) shows the reinforcement webs 1010, 1012, 1014 and 1016 in cross section and FIG. 10(*c*) shows a more detailed view of the cross section. The reinforcement webs 1010, 1012, 1014 and 1016 have a triangular cross section and extend downwardly from the top flange 76 of the second stage 70 on the inside of the second stage 70 and on either side of the porthole 76.

FIG. 11 is a table of design data for selecting one of the standard types of strengthening towers of FIGS. 8(*a*) to 8(*e*). Typically, a designer of the monopole uses a model of the monopole that incorporates the equipment, such as transmitters 14, currently installed towards the top of the monopole. Depending on the size and shape of the equipment a moment is created by wind asserting a force on the equipment.

The monopole 10 is designed for a maximum moment capacity at high wind speeds and if the installation of additional equipment causes the moment to exceed the maximum moment capacity of the monopole, the proposed strengthening tower is constructed around the monopole. Since a moment depends on the length of a lever, that is monopole 10, the moment is greatest at the base of the monopole and smallest at the top.

The table in FIG. 11 contains data for the maximum moment capacity of the different types of strengthening towers of FIGS. 8(*a*) to 8(*e*). In one example, monopole 10 is designed for a maximum moment capacity at the base (at 0 m) of 800 kNm but due to additional equipment the moment at the base has increased to 1200 kNm. In this example, a tower of type B would be selected, since the design moment at 0 m is 1500 kNm, which is more than the required moment. This selection is made under the assumption that the diameter of the type B tower (1200 mm) is sufficient to accommodate cabling along the outside of the monopole. Otherwise, a type with a larger diameter needs to be selected.

In the same example, the moment at 2 m also exceeds the maximum moment capacity of the monopole but at 4 m the moment is less than the maximum moment capacity of the monopole. As a result, only one more stage, that is two stages in total, are required. More stages may be added later, when more equipment is installed that causes the moment at 4 m or above to exceed the maximum moment capacity of the monopole.

In cases where installation of large amounts of equipment is expected for the future, a type is selected that has a much higher maximum moment capacity at 0 m than is required. For the example above, although type B is sufficient type C may be selected in order to be able to withstand moments of up to 2400 kNm at 0 m in the future.

Although the invention has been described with reference to a particular example it should be appreciated that it may be embodied in many other forms and variations.

The invention claimed is:

1. A monopole hollow strengthening tower comprising:

a plurality of stages, each comprising a pair of half-pipe sections adapted to fit around a monopole, the plurality of stages comprising:

a first stage adapted to be connected to a footing of a monopole, wherein the footing for the monopole is strengthened by causing a concrete foundation around an existing footing and setting an upper level of the foundation at a first predetermined distance below a lowest cable tray, and, wherein the half-pipe sections of the first stage have a height equal to the first predetermined distance;

a second stage adapted to be connected to a top portion of the first stage, the second stage comprising at least one cable port designed for a particular cabling requirement of the monopole;

a third stage, wherein the half-pipe sections thereof have the same diameter as the half-pipe sections of the first stage;

a plurality of subsequent stages, each subsequent stage adapted to be connected to a top portion of a preceding stage; and a top stage having a top flange, which incorporates a clamping system located on the top flange, such that the top stage is the only stage above the footing of the monopole where the monopole and the strengthening tower are in contact with each other when the monopole hollow strengthening tower is assembled.

2. The monopole hollow strengthening tower according to claim 1, wherein a bolt cage is embedded in the concrete foundation to connect to the first stage.

3. The monopole hollow strengthening tower according to claim 1, wherein the half-pipe sections for the first stage have a diameter selected from a plurality of predetermined different diameters.

4. The monopole hollow strengthening tower according to claim 3, wherein the first predetermined distance is 2 meters.

5. The monopole hollow strengthening tower according to claim 1, wherein the half-pipe sections for the third stage and the subsequent stages have a length selected from a plurality of predetermined different lengths.

6. The monopole hollow strengthening tower according to claim 1, wherein the half-pipe sections for the first stage and the third stage are selected from multiple predetermined types.

7. The monopole hollow strengthening tower according to claim 1, wherein the strengthening tower is fabricated from steel or carbon fibre half-pipe sections.

8. The monopole hollow strengthening tower according to claim 1, wherein the half-pipe sections include flanges along their vertical edges for connection to each other.

9. The monopole hollow strengthening tower according to claim 1, wherein the half-pipe sections also have semi-circular flanges around their top and bottom edges for connection to the stages above and below.

10. The monopole hollow strengthening tower according to claim 9, wherein webs are incorporated between the flanges and the outer wall of each half-pipe section for further stiffening.

11. The monopole hollow strengthening tower according to claim 1, wherein the cable ports are located at joints in the half-pipe sections.

12. The monopole hollow strengthening tower according to claim 1, wherein additional overturning resistance is provided by screw piles, rock anchors or bored piers, that are connected to the concrete foundation.

13. The monopole hollow strengthening tower according to claim 1, wherein only the second stage is customised to the monopole by having the at least one cable port for existing, as well as any new, cable bundles.

14. The monopole hollow strengthening tower according to claim 1, wherein the monopole hollow strengthening tower extends above the monopole.

15. A method for strengthening a monopole, by installing a hollow strengthening tower around it, where the hollow strengthening tower comprises a number of stages that each comprises a pair of half-pipe sections that are connected to the stage below and to each other;

the method comprising:

casting a concrete foundation'around an existing monopole footing;

setting an upper level of the concrete foundation at a first predetermined distance below a lowest cable tray;

installing a pair of half-pipe sections for the first stage that has a height equal to the first predetermined distance;

installing a second stage that is connected to the top of the first stage and that includes cable ports designed for a particular cabling requirement of the monopole;

installing a pair of half-pipe sections of a third stage, which have the same diameter as the half-pipe sections of the first stage; and installing a top stage having a top flange, which incorporates a clamping system located on the top flange to grip the monopole, wherein the top stage is the only stage where the monopole and strengthening tower are in contact with each other.

16. A monopole hollow strengthening tower comprising:

a first stage connected to a footing of a monopole;

a second stage connected to the top of the first stage and including cable ports designed for a particular cabling requirement of the monopole; and a plurality of subsequent stages extending above the second stage;

a top stage having a top flange, which incorporates a clamping located on the top flange;

wherein the first, second, and subsequent stages each comprise a pair of half-pipe sections that fit around the monopole, wherein each pair of half-pipe sections is connected to the stage below and to each other, wherein the footing for the monopole is strengthened by casting a concrete foundation around an existing footing and setting an upper level of the foundation at a first predetermined distance below a lowest cable tray, wherein the half-pipe sections of the first stage have a height equal to the first predetermined distance, and wherein the half-pipe sections of a third stage have the same diameter as the half-pipe sections of the first stage.

* * * * *

UNITED STATES PATENT AND TRADEMARK OFFICE

CERTIFICATE OF CORRECTION

PATENT NO. : 9,166,274 B2
APPLICATION NO. : 13/435690
DATED : October 20, 2015
INVENTOR(S) : Alan Samuel Bennett It is certified that error appears in the above-identified patent and that said Letters Patent is hereby corrected as shown below:

On the title page, Column 2, Item (57) ABSTRACT, Line 7, delete "stage, finally" and insert -- stage. Finally --

On the title page, Column 2, Item (57) ABSTRACT, Line 13, delete "footprint" and insert -- footprint. --

In the claims,

Column 10, Line 35, Claim 15, delete "foundation'around" and insert -- foundation around --

Signed and Sealed this
Twenty-ninth Day of March, 2016

Michelle K. Lee

Michelle K. Lee
*Director of the United States Patent and Trademark Office*